US011103839B2

(12) United States Patent
Ng et al.

(10) Patent No.: US 11,103,839 B2
(45) Date of Patent: Aug. 31, 2021

(54) METHOD FOR IN SITU MIXING OF LIQUID COMPOSITIONS WITH DYNAMIC FILLING PROFILES

(71) Applicant: The Procter & Gamble Company, Cincinnati, OH (US)

(72) Inventors: Boon Ho Ng, Beijing (CN); Justin Thomas Cacciatore, Cincinnati, OH (US); Sebastian Vargas, Cincinnati, OH (US); Scott William Capeci, North Bend, OH (US); Vincenzo Guida, Woluwe Saint Pierre (BE)

(73) Assignee: The Procter & Gamble Company, Cincinnati, OH (US)

( * ) Notice: Subject to any disclaimer, the term of this patent is extended or adjusted under 35 U.S.C. 154(b) by 212 days.

(21) Appl. No.: 16/001,965

(22) Filed: Jun. 7, 2018

(65) Prior Publication Data

US 2018/0353914 A1 Dec. 13, 2018

(30) Foreign Application Priority Data

Jun. 8, 2017 (WO) ..... PCT/CN2017/087537

(51) Int. Cl.

| | |
|---|---|
| ***B01F 3/08*** | (2006.01) |
| ***B01F 15/04*** | (2006.01) |
| ***B01F 15/00*** | (2006.01) |
| ***C11D 17/08*** | (2006.01) |
| ***C11D 3/12*** | (2006.01) |
| ***C11D 3/50*** | (2006.01) |
| ***C11D 3/386*** | (2006.01) |
| ***C11D 3/39*** | (2006.01) |
| ***C11D 3/00*** | (2006.01) |
| ***B01F 13/10*** | (2006.01) |
| ***B01F 5/02*** | (2006.01) |
| ***C11D 11/00*** | (2006.01) |

(52) U.S. Cl.

CPC ..... *B01F 3/0865* (2013.01); *B01F 3/088* (2013.01); *B01F 5/02* (2013.01); *B01F 13/1055* (2013.01); *B01F 15/00344* (2013.01); *B01F 15/00422* (2013.01); *B01F 15/042* (2013.01); *B01F 15/0479* (2013.01); *C11D 3/0089* (2013.01); *C11D 3/1213* (2013.01); *C11D 3/1266* (2013.01); *C11D 3/386* (2013.01); *C11D 3/3905* (2013.01); *C11D 3/50* (2013.01); *C11D 11/0094* (2013.01); *C11D 17/08* (2013.01)

(58) Field of Classification Search

CPC ..... B01F 3/0865
USPC ..... 366/167.2, 179.1; 141/9
See application file for complete search history.

(56) References Cited

U.S. PATENT DOCUMENTS

| | | | | |
|---|---|---|---|---|
| 2,771,913 | A * | 11/1956 | Flasnocker | A47G 21/00 141/9 |
| 5,324,109 | A | 6/1994 | Johari | |
| 9,918,584 | B2 | 3/2018 | Bergdahl et al. | |
| 2003/0121561 | A1* | 7/2003 | Wagner | B01F 15/00194 141/9 |
| 2013/0014857 | A1* | 1/2013 | Kinds | B67D 1/0894 141/9 |
| 2017/0056847 | A1* | 3/2017 | Miller | B67C 3/208 |

FOREIGN PATENT DOCUMENTS

WO WO03097516 A1 11/2003

OTHER PUBLICATIONS

AA1227_PCT_Search_Report for International App. No. PCT/CN2017/087537, dated Mar. 12, 2018, 4 pages.
AA1228_Search_Report for International App. No. PCT/CN2017/087538, dated Mar. 8, 2018, 4 pages.
U.S. Appl. No. 16/001,970, filed Jun. 7, 2018, Hongling Chen.

* cited by examiner

*Primary Examiner* — David L Sorkin
(74) *Attorney, Agent, or Firm* — Gary J. Foose

(57) ABSTRACT

Methods for in situ mixing of two or more different liquid compositions by employing a dynamic flow profile characterized by a ramping-up section and/or a ramping-down section.

19 Claims, 3 Drawing Sheets

METHOD FOR IN SITU MIXING OF LIQUID COMPOSITIONS WITH DYNAMIC FILLING PROFILES

FIELD OF THE INVENTION

This invention relates to methods for in situ mixing of two or more different liquid compositions, and especially for purpose of forming a homogeneous and stable liquid composition inside a container.

BACKGROUND OF THE INVENTION

Traditional industry-scale methods for forming liquid consumer products (e.g., liquid laundry detergents, liquid fabric care enhancers, liquid dish-wash detergents, liquid hard-surface cleaners, liquid air fresheners, shampoos, conditioners, body-wash liquids, liquid hand soaps, liquid facial cleansers, liquid facial toners, moisturizers, and the like) involve mixing multiple raw materials of different colors, density, viscosity, and solubility in large quantities (e.g., through either batch mixing or continuous in-line mixing) to first form a homogenous and stable liquid composition, which is then filled into individual containers, followed subsequently by packaging and shipping of such containers. Although such traditional methods are characterized by high throughput and satisfactory mixing, the nevertheless suffer from lack of flexibility. If two or more different liquid consumer products need to be made using the same production line, the production line needs to be cleaned or purged first before it is used to make a different liquid consumer product. Such cleaning or purging step also generates a significant amount of "waste" liquid that cannot be used in either product.

There is therefore a need for more flexible industry-scale methods for forming liquid consumer products that are well mixed with satisfactory homogeneity and stability. It is further desired that such methods generate little or no "waste" liquid and allow maximum utilization of the raw materials.

SUMMARY OF THE INVENTION

This invention provides an in situ liquid mixing method, i.e., two or more liquid raw materials are mixed directly inside a container (e.g., a bottle, a pouch or the like) that is designated for housing a finished liquid consumer product during shipping and commercialization of such product, or even during usage after such product has been sold. More specifically, the present invention employs a dynamic filling profile for filling the container, which can help to reduce splashing, rebounding, and associated negative effects (such as aeration) inside the container caused by high-speed filling, and/or to improve thoroughness of the mixing and to ensure that the finished liquid consumer product so formed has satisfactory homogeneity and stability. More importantly, with the splashing and rebounding under control, it is possible to push the filling speed even higher, thereby significantly reducing the filling time and improving the system throughput.

In one aspect, the present invention relates to a method of filling a container with liquid compositions, which includes the step of:

(A) providing a container that has an opening, wherein the total volume of said container ranges from about 100 ml to about 10 liters;

(B) providing a first liquid feed composition and a second liquid feed composition that is different from the first liquid feed composition;

(C) partially filling said container with the first liquid feed composition to from about 0.01% to about 50% of the total volume of said container; and (D) subsequently, filling the remaining volume of the container, or a portion thereof, with the second liquid feed composition, while the second liquid feed composition is filled through the top opening into the container by one or more liquid nozzles, while such one or more liquid nozzles are arranged to generate one or more liquid flows characterized by a dynamic flow profile, which includes an increasing flow rate at the beginning of step (D) and/or a decreasing flow rate at the end of step (D) in combination with a peak flow rate during the middle of step (D).

Preferably, the dynamic flow profile includes both the increasing flow rate at the beginning of step (D) and the decreasing flow rate at the end of step (D).

Preferably, the peak flow rate ranges from about 50 ml/second to about 10 L/second, more preferably from about 100 ml/second to about 5 L/second, and most preferably from about 500 ml/second to about 1.5 L/second.

The total time for filling the second liquid feed composition during step (D) preferably ranges from about 1 second to about 5 seconds. Preferably, the peak flow rate remains substantially constant for a duration that is at least 50% of the total filing time.

In a particularly preferred but not necessary embodiment of the present invention, the increasing flow rate at the beginning of step (D) starts from 0 ml/second and reaches about 80% or more of the peak flow rate within a ramping-up duration of from about 0.1 second to about 1 second.

In addition to or alternatively, the decreasing flow rate at the end of step (D) starts from the peak flow rate and reaches about 50% or less thereof, preferably about 10% or less thereof, and more preferably 0 ml/second within a ramping-down duration of from about 0.05 second to about 0.5 second. More preferably, the decreasing flow rate at the end of (D) starts from the peak flow rate and reaches about 1-50%, preferably 2-30%, and more preferably 5-10% thereof of within a ramping-down duration of from about 0.05 second to about 0.5 second, and then reduces to 0 ml/second within a shut-down duration of less than about 0.01 second, and preferably of less than about 0.001 second.

The one or more liquid nozzles are preferably connected to one or more flow-controlling devices that function to control liquid flow rates from such nozzles. Such one or more flow-controlling devices can be readily selected from the group consisting of valves, pistons, servo-driven pumps, and combinations thereof. Preferably, such one or more flow-controlling devices include one or more servo-driven pumps.

The first liquid feed composition is present in the container as a minor feed (e.g., containing one or more perfumes, colorants, opacifiers, pearlescent aids such as mica, titanium dioxide coated mica, bismuth oxychloride, and the like, enzymes, brighteners, bleaches, bleach activators, catalysts, chelants, polymers, etc.), i.e., during step (C), 0.1-50%, preferably 0.1-40%, more preferably 0.1-30%, still more preferably 0.1-20%, and most preferably 0.1-10% of the total volume of the container is filled with the first liquid feed composition. In addition, it is preferred that the second liquid feed composition is present in the container as a major feed (e.g., containing one or more surfactants, solvents, builders, structurants, etc.), i.e., during step (D), at least 50%, preferably at least 70%, more preferably at least 80%, and most preferably at least 90%, of the total volume of the container is filled with the second liquid feed composition.

In order to minimize the error margin associated with the dynamic filling profile of the present invention, it is desirable to control aeration in at least the second liquid feed composition, e.g., to an Aeration Level of about 5% or less by volume, preferably of about 3% or less by volume, more preferably of about 2% or less by volume, and most preferably of about 1% or less by volume. Preferably, aeration in the first liquid feed composition is also controlled in a similar manner.

These and other aspects of the present invention will become more apparent upon reading the following detailed description of the invention.

DETAILED DESCRIPTION OF THE INVENTION

Figure 1:
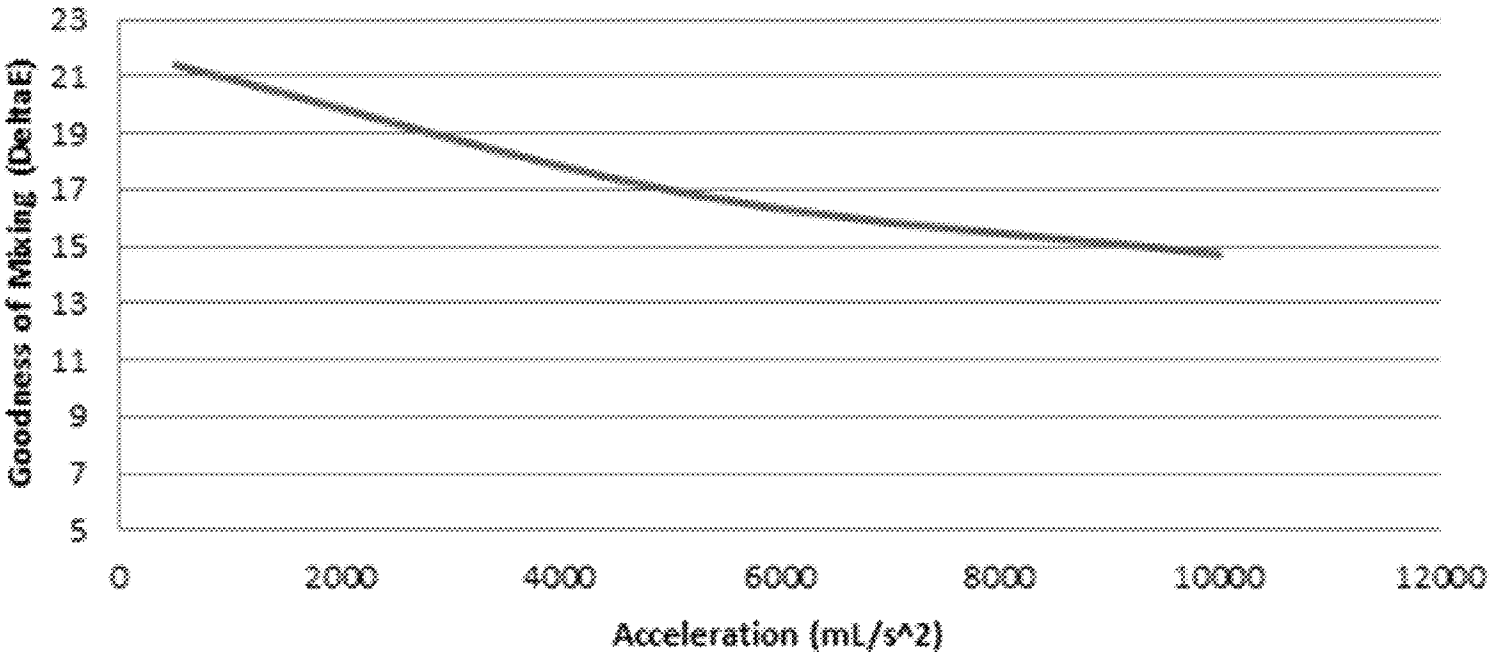
FIG. 1 is a graph plotting the goodness of mixing (as indicated by the relative color difference ΔE between a sample liquid mixture and a reference liquid mixture that is perfectly homogenous) achieved by employing ramping-up dynamic filling flow profiles having increasing flow rates at the beginning of the major filling step, while such increasing flow rates are characterized by different acceleration rates.

As used herein, the term "in situ" refers to real-time mixing that occurs inside a container (e.g., a bottle or a pouch) that is designated for housing a finished liquid consumer product (e.g., a liquid laundry detergent, a liquid fabric care enhancer, a liquid dish-wash detergent, a liquid hard-surface cleaner, a liquid air freshener, a shampoo, a conditioner, a liquid body-wash, a liquid hand soap, a liquid facial cleanser, a liquid facial toner, a moisturizer, and the like) during shipping and commercialization of such product, or even during usage after such product has been sold. In situ mixing of the present invention is particularly distinguished from the in-line mixing that occurs inside one or more liquid pipelines that are positioned upstream of the container, and preferably upstream of the filling nozzle(s). In situ mixing is also distinguished from the batch mixing that occurs inside one or more mixing/storage tanks that are positioned upstream of the liquid pipelines leading to the container.

As used herein, the term "substantially constant" refers to having less than about 10% of fluctuation, either plus or minus.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

The container according to the present invention is a container that is specifically designated for housing a finished liquid consumer product during shipping and commercialization of such product, or even during usage after such product has been sold. Suitable containers may include pouches (especially standup pouches), bottles, jars, cans, cartons that are water-proof or water-resistant, and the like.

Such container typically includes an opening through which liquids (either liquid raw materials or the finished liquid consumer products) can be filled into and dispensed from it. The opening can have different geometries and various cross-sectional shapes. For example, the opening be tubular or cylindrical with a substantial height and a circular or nearly circular cross-section. For another example, the opening may have a substantial height but an oval, triangular, square, or rectangular cross-section. For yet another example, the opening may have a minimal height that is negligible and is therefore only defined by its cross-sectional shape. Such opening has a center point or centroid. In a conventional liquid filling process, one or more liquid filling nozzles are placed either at such centroid or in its vicinity (e.g., either slightly above it or below it) for generating one or more vertical liquid influxes into the container.

The container also has a supporting plane, which is defined by three or more points upon which the container can stand alone stably, regardless of the shape or contour of its supporting surface. It is important that the presence of such a supporting plane does not require that the container have a flat supporting surface. For example, a container may have a concaved supporting surface, while the outer rim of such concave supporting surface defines a supporting plane upon which the container can stand alone stably. For another example, a container may have a supporting surface with multiple protrusions, while three or more such protrusions define a supporting plane upon which the container can stand alone stably.

The container may also have a top end, an opposing bottom end, and one or more side walls that extend between the top end and the bottom end. The above-mentioned opening is typically located at the top end of the container. The above-mentioned supporting plane can be located at the opposing bottom end of the container and is thus defined by a bottom surface of such container (e.g., a typical upstanding liquid bottle that stands on its bottom end). Alternatively, the above-mentioned supporting plane can be located at the top end of the container and is thus defined by a top surface of such container (e.g., an inverse liquid bottle that stands on its top end).

The container may also have a longitudinal axis that extends through the centroid of the above-mentioned opening and is perpendicular to the above-mentioned supporting plane. Please note that although preferred, it is not necessary for the container to have an elongated shape, i.e., the longitudinal axis is not defined by the shape of the container, but is rather defined by the location of the centroid of the container opening and the supporting plane of the container.

Such container may further contain one or more side walls between the top end and the bottom end. For example, such container may be a cylindrical or near cylindrical bottle with one continuous curved side wall that connects its top end and its bottom end, which defines a circular or oval shaped bottom surface. For another example, the container may be a standup pouch with two planar side walls that meet at its bottom end to form an almond-shaped bottom surface as well as at its top end to form a straight-line opening/closure. Further, the container may have three, four, five, six or more planar or curved side walls that connect the top end and the bottom end.

The container of the present invention is filled with two or more different liquid feed compositions, which will mix in situ inside such container. Such liquid feed compositions may differ in any aspect, e.g., colors, density, viscosity, and solubility, that may potentially lead to inhomogeneity or phase separation in the resulting mixture.

Preferably, the container is first filled with a first liquid feed composition, which may be present in the container as a minor feed, i.e., the first liquid feed composition only fills up to about 0.1-50%, preferably about 0.1-40%, more preferably about 1-30%, still more preferably about 0.1-20%, and most preferably about 0.1-10% of the total volume of the container. Such a minor feed composition may contain, for example, one or more perfumes, colorants, opacifiers, pearlescent aids, enzymes, brighteners, bleaches, bleach activators, catalysts, chelants, or polymers, or combinations thereof. Preferably, such minor feed composition contains at least one pearlescent aid selected from the group consisting of mica, titanium dioxide coated mica, bismuth oxychloride, and combinations thereof. Note that the present invention is not limited to a single minor feed, and may include two or more minor feeds that are simultaneously or sequentially filled into the container to form such minor feed composition as a mixture of such two or more minor feeds.

Next, the container is preferably filled with a second liquid feed composition, which may be present in the container as a major feed, i.e., the second liquid feed composition fills at least about 50%, preferably at least about 70%, more preferably at least about 80%, and most preferably at least about 90%, of the total volume of the container. Such a major feed composition may contain, for example, one or more surfactants, solvents, builders, or structurants, or combinations thereof. Note that the present invention is not limited to a single major feed, and may include two or more major feeds that are simultaneously or sequentially filled into the container to form such major feed composition as a mixture of such two or more major feeds.

Subsequently, the container can be filled with one or more additional liquid feed compositions containing one or more additives or benefit agents needed for forming the finished liquid consumer products of the present invention.

Filling of the container is carried out by one or more liquid nozzles, which are placed at or near the opening of the container for generating one or more liquid influxes into the container through such opening. The nozzles may have any size or form that are suitable for jet-filling of liquid contents.

In order to achieve good homogeneity and stability in the finished liquid consumer products formed by in situ mixing, jet mixing is employed to impart a sufficient amount of kinetic energy into the liquid feeds as they enter the container (e.g., bottle or pouch). Inventors of the present invention have discovered that the employment of a dynamic flow profile for filling the container, especially during the major feed stage, may be effective in increasing the impact of a given amount of kinetic energy on the mixing results, and/or minimizing undesired splashing or rebound of the liquid content inside the container.

Specifically, such dynamic flow profile is preferably time-dependent and includes: (a) a ramping-up section, which is defined by an increasing flow rate of the liquid feed at the beginning of the major filling step, i.e., step (D) as mentioned hereinabove; and/or (b) a ramping-down section, which is defined by a decreasing flow rate of the liquid feed at the end of the major filling step. The increasing flow rate during the ramping-up section can but does not have to have a constant acceleration rate; it may have a varying acceleration rate and may even resemble the rising portion of a bell curve or a sine wave. Similarly, the decreasing flow rate during the ramping-down section can but does not have to have a constant deceleration rate. In a specific embodiment of the present invention, such dynamic flow profile includes only the ramping-up section, but not the ramping-down section. In an alternative embodiment, the dynamic flow profile includes only the ramping-down section, but not the ramping-up section. In yet another alternative embodiment (most preferred), the dynamic flow profile includes both the ramping-up section and the ramping-down section.

Between the ramping-up and ramping-down sections of the dynamic flow profile is a peak flow rate that ranges from about 50 ml/second to about 10 L/second, more preferably from about 100 ml/second to about 5 L/second, and most preferably from about 500 ml/second to about 1.5 L/second. The peak flow rate may be present as a single point in the dynamic flow profile.

Alternatively, it may remain substantially constant for a significant duration, e.g., at least 50% of the total filling time for the second liquid feed composition during step (D), thereby defining a constant-flow section for the dynamic flow profile of the present invention with less than about 8%, more preferably less than about 5%, and most preferably less than about 2% of flow rate variation. Still further, the dynamic flow profile of the present invention may have a middle section that includes multiple "peaks" and "valleys" with constantly changing flow rates, while the maximum of such "peaks" defines the overall peak flow rate.

The total time for filling the second liquid feed composition during step (D) preferably ranges from about 0.1 second to about 5 seconds, preferably from about 0.5 second to about 4 seconds, and more preferably from about 1 second to about 3 seconds.

The ramping-up section of the dynamic flow profile of the present invention is characterized by an increasing flow rate that starts from 0 ml/second and reaches about 80% or more of the above-descried peak flow rate within a ramping-up duration of from about 0.1 second to about 1 second. For example, the increasing flow rate may ramp up from 0 ml/second to about 50 ml/second in about 1 second as a minimum, or to about 10 L/second in about 0.1 second as a maximum. Correspondingly, such an increasing flow rate may be further defined by an acceleration rate ranging from about 50 ml/second$^2$ to about 100 L/second$^2$, preferably from about 100 ml/second$^2$ to about 50 L/second$^2$, more preferably from about 500 ml/second$^2$ to about 20 L/second$^2$, and most preferably from about 5 L/second$^2$ to about 15 L/second$^2$ (i.e., 5,000-15,000 ml/second$^2$). Such a ramping-up section with the increasing flow rate of the liquid feed enables better mixing of different liquids inside the container.

The ramping-down section of the dynamic flow profile of the present invention is characterized by a decreasing flow rate that starts from the above-described peak flow rate and reaches about 50% or less thereof, preferably about 10% or less thereof, and more preferably 0 ml/second within a ramping-down duration of from about 0.05 second to about 0.5 second. For example, the decreasing flow rate may ramp down from about 50 ml/second to 0 ml/second within 0.5 second as a minimum, or from about 10 L/second to 0 ml/second in 0.05 second as a maximum. Correspondingly, such a decreasing flow rate may be further defined by a deceleration rate ranging from about 100 ml/second$^2$ to about 200 L/second$^2$, preferably from about 1 L/second$^2$ to about 100 L/second$^2$, more preferably from about 5 L/second$^2$ to about 20 L/second$^2$, and most preferably from about 8 L/second$^2$ to about 12 L/second$^2$ (i.e., 8,000-12,000 ml/second$^2$). Such a ramping-down section with the decreasing flow rate of the liquid feed functions to reduce rebounding and splashing of the liquid feed onto the interior walls of the container. Note that significant splashing may also hinder thorough mixing and result in localized non-homogeneous spots.

In a particularly preferred but not necessary embodiment of the present invention, the ramping-down section of the dynamic flow profile further includes two sequential sub-sections, in the first of which (i.e., a "dribble" sub-section) the decreasing flow rate starts from the above-described peak flow rate and reaches about 1-50% thereof of within a ramping-down duration of from about 0.05 second to about 0.5 second, and in the second of which (i.e., a "shut-down" sub-section) it then reduces to 0 ml/second within a shut-down duration of less than about 0.01 second, and preferably of less than about 0.001 second. Such sequential sub-sections function to improve the overall filling accuracy of the method of the present invention. Because the dynamic flow profile with the ramping-up and ramping-down sections is effectuated and controlled by one or more flow meters, and because flow meters can become less accurate at very low flow rates, the provision of a "dribble" sub-section allows the ramping-down to proceed to a target low flow rate that is still accurately detectable by the flow meters, and once that target low flow rate is reached, the system will effectuate an immediate shut-down to avoid overfilling. Preferably, the dribble sub-section is defined by a dribble flow rate ranging from about 50 ml/second to about 1000 ml/second, and more preferably from about 500 ml/second to about 900 ml/second, and most preferably from about 600 ml/second to about 800 ml/second. As the dribble flow rate increases within these ranges, an improved mixing result is observed.

The ramping-down section of the dynamic flow profile of the present invention may even include a sub-section with a reverse liquid flow, i.e., with some air being sucked into the filling pipelines, thereby resulting in a complete shutting down of the filling process. Such a reverse liquid flow may help to eliminate a positive shutoff nozzle. It can also improve dosing accuracy to ensure that the liquid feed flow is truly cut off at exactly the right time.

The one or more liquid nozzles for filling the second liquid feed composition into the container is preferably connected to one or more flow-controlling devices that function to control liquid flow rates from such nozzles. Such one or more flow-controlling devices can be readily selected from the group consisting of valves, pistons, servo-driven pumps, and combinations thereof. Preferably, the one or more flow-controlling devices include one or more servo-driven pumps, such as, for example, one or more servo-driven Waukesha PD size 018 pump. By employing such servo-driven pumps, the present invention is able to accurately and flexibly modify and control the dynamic flow profile of the liquid flows that are going through the liquid nozzles, which maximizes the impact of kinetic energy input upon the mixing results, minimizing splashing and formation of non-homogeneous spots on the interior walls of the container, and enables a successful filling operation.

It is also preferred that the one or more liquid nozzles are connected to one or more flow-rate measuring devices, such as flow meters, which can measure in real time the dynamic flow rates of the liquid feeds that are going through the liquid nozzles and feed such information back to the servo-driven pump for adjustment as needed.

In order to minimize the error margin associated with the dynamic filling profile of the present invention, it is desirable to control aeration in at least the second liquid feed composition, e.g., to an Aeration Level of 5% or less by volume, preferably of 3% or less by volume, more preferably of 2% or less by volume, and most preferably of 1% or less by volume. Preferably, aeration in the first liquid feed composition is also controlled in a similar manner.

Controlled aeration can be achieved prior to filling by placing the liquid feed compositions in de-aeration tanks for an extended period of time, either under atmospheric pressure or under vacuum conditions, so as to allow trapped air bubbles to be released from such liquid feed compositions. Quantification of aeration levels in the compositions is by way of a hydrometer assessing the specific gravity between aerated and un-aerated compositions under the atmospheric pressure.

Test Methods

A. Color Difference (ΔE) Measurement for Evaluating Goodness of Mixing

The minor feed (with at least a colorant such as a dye) and the major feed are filled sequentially into a transparent container and mixed in situ, as described hereinabove. Preferably, the transparent container is a transparent plastic bottle. The transparent plastic bottle is fitted into a rigid and non-transparent frame, both of which are then placed inside a dark room facing a Canon Rebel DSLR camera, while a LED light is placed behind such plastic bottle to provide illumination that shines through the plastic bottle into the camera.

The camera captures a digital image of each in situ mixing sample in the above-described setting ("Sample Image"). Further, the camera captures a digital image of a perfect mixture, which is formed by the same minor and major feeds as the in situ mixing sample, in the same setting ("Reference Image"). The Sample Image and the Reference Image are then input into a computer equipped with an automated image analysis software program (e.g., a MATLAB code) for calculating an overall color difference score ($\Delta E_{Overall}$) between the Sample Image and the Reference Image in the L/a/b color space. Preferably, the PP bottle contains a body and a handle, so each of the Sample Image and the Reference Image are divided into a body region and a handle region that are analyzed separately. Specifically, the color difference score between the body regions of the Sample Image and the Reference Image ($\Delta E_{Body}$) is separately calculated from the color difference score between the handle regions of the Sample Image and the Reference Image ($\Delta E_{Handle}$). Then the overall color difference score ($\Delta E_{Overall}$) is calculated as a weighted average of $\Delta E_{Body}$ and $\Delta E_{Handle}$, e.g., at a 50%:50% weight ratio.

Specifically, the MATLAB code programs the computer to carry out the following steps:

1. Each digital image (either the Sample Image and the Reference Image) is converted from the RGB color space to the L/a/b color space;
2. The L, a, b values of each pixel in such digital image are stored as separate values;
3. The ΔE values between each pixel in a Sample Image ("S") and a corresponding pixel in the Reference Image ("R") are calculated by the following formula:

$$\Delta E=\sqrt{(L_R-L_S)^2+(a_R-a_S)^2+(b_R-b_S)^2}$$

4. For a respective region of interest ("i"), e.g., the body region or the handle region, an average ΔE ("$\Delta E_i$") is calculated from the ΔE values of all pixels in such region.
5. An overall weighted average ΔE is then calculated as follows, assuming that the total number of regions of interest is n):

$$\Delta E_{Overall} = \sum_{i=1}^{n} (\text{Weight } \%_i \times \Delta E_i)$$

Typically, the lower the $\Delta E_{Overall}$, the better the mixing result, because it means that the color difference between the Sample Image and the Reference Image (representative of a perfectly mixed sample) is smaller.

EXAMPLES

Example 1: Dynamic Filling Flow Profiles with Ramping-Up During the Major Feed Step A transparent plastic bottle is filled sequentially with: (1) about 2.5 grams of a blue dye premix ("Minor Feed 1"); (2) about 29 grams of a perfume premix ("Minor Feed 2"); and (3) a bulk liquid composition containing surfactants, builders, and solvents ("Major Feed"), to reach a total filled weight of about 1400 grams.

The Major Feed is filled into the bottle by using "ramping-up" dynamic flow profiles, i.e., with initial increasing flow rates of different acceleration rates that range from nearly 0 to about 10000 ml/s$^2$. Digital images of the resulted mixing samples are then captured and compared with a Reference Sample to calculate an overall color difference score ($\Delta E_{Overall}$) for each of such resulted mixing samples. FIG. 1 shows a graph that plots the $\Delta E_{Overall}$ values of the resulted mixing samples against the acceleration rates of the dynamic flow profiles used. It is evident from this graph that the higher the acceleration rate (up to a maximum acceleration rate of 10000 ml/s$^2$), the lower the $\Delta E_{Overall}$ value, i.e., the better the mixing result.

Figure 2B:
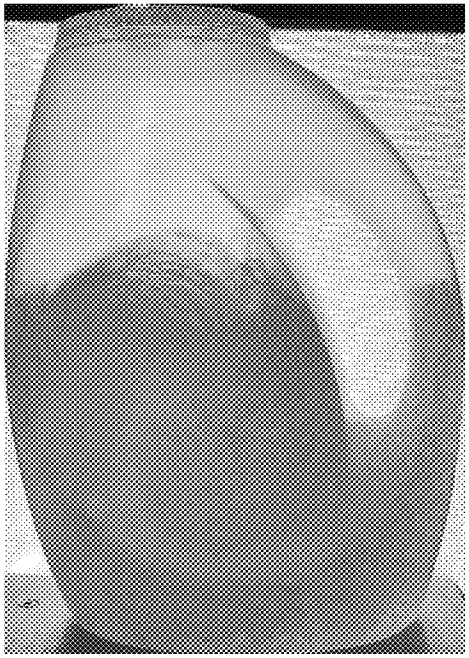
FIGS. 2A and 2B are two photographs taken during the major filling step, where one (FIG. 2A) shows the maximum liquid rebound observed when using a non-ramping filling flow profile, and the other (FIG. 2B) shows the maximum liquid rebound observed when using a ramping-down dynamic filling flow profile with decreasing flow rates at the end of the major filling step.
Figure 2A:
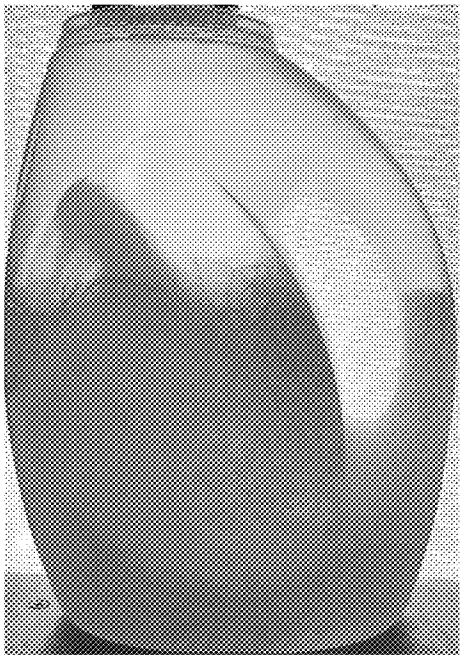

Example 2: Dynamic Filling Flow Profile with Ramping-Down During the Major Feed Step Minor feeding and major feeding are carried out as described hereinabove in Example 1, except that the Major Feed is now filled into the bottle by using an AS-FS pneumatic valve commercially available from SMC Pneumatics (Yorba Linda, Calif.), which is capable of providing: (1) a non-ramping down flow profile, i.e., without any decreasing flow rate at the end when such pneumatic valve is manually set at Dial 12; and (2) a "ramping-down" dynamic flow profile with the same peak flow rate, but with an end decreasing flow rate when such pneumatic valve is manually set at Dial 2. Pictures are taking during such Major Feed step to record the maximum rebounding occurred during such step. FIG. 2A shows that visible rebounding occurs during (1), while FIG. 2B shows significantly less visible rebounding during (2).

Figure 3:
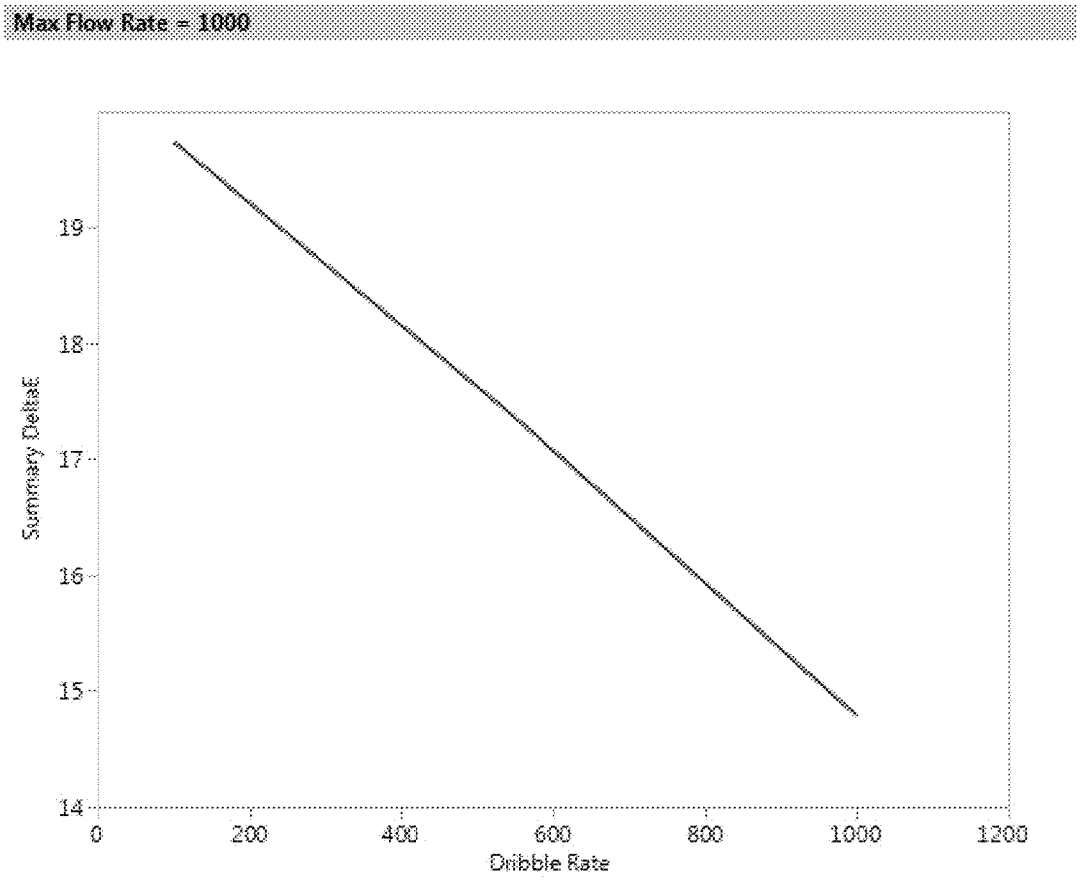
FIG. 3 is a graph plotting the goodness of mixing (ΔE) achieved by employing ramping-down dynamic filling flow profiles having decreasing flow rates at the end of the major filling step, while decreasing flow rates are characterized by a constant deceleration rate but different dribble flow rates.

Example 3: Dynamic Filling Flow Profiles with Ramping-Down and Dribble During the Major Feed Step Minor feeding and major feeding are carried out as described hereinabove in Example 1, except that the Major Feed is now filled into the bottle by using "ramping-down and dribbling" dynamic flow profiles, i.e., with a peak flow rate of about 1000 ml/second followed by a decreasing flow rate characterized by a constant deceleration rate of about 10000 ml/s$^2$ and different dribble flow rates ranging from about 100 ml/second to about 1000 ml/second. Digital images of the resulted mixing samples are then captured and compared with a Reference Sample to calculate an overall color difference score ($\Delta E_{Overall}$) for each of such resulted mixing samples. FIG. 3 shows a graph that plots the $\Delta E_{Overall}$ values of the resulted mixing samples against the different dribble flow rates used. It is evident from this graph that the higher the dribble flow rate (up to a maximum of about 1000 ml/s), the lower the $\Delta E_{Overall}$ value, i.e., the better the mixing result.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of filling a container with liquid compositions, comprising the step of:

(A) providing said container, wherein said container has an opening, wherein the total volume of said container ranges from about 10 ml to about 10 liters;

(B) providing a first liquid feed composition and a second liquid feed composition that is different from said first liquid feed composition;

(C) partially filling said container with the first liquid feed composition to from about 0.01% to about 50% of the total volume of said container; and (D) subsequently, filling the remaining volume of the container, or a portion thereof, with the second liquid feed composition and thereby mixing within said container said second liquid feed composition with said first liquid feed composition, wherein the first liquid feed composition and the second liquid feed composition is are filled through the opening into said container by one or more liquid nozzles placed at or near said opening, wherein said one or more liquid nozzles are arranged to generate one or more liquid flows characterized by a dynamic flow profile, which comprises an increasing flow rate at the beginning of step (D) and/or a decreasing flow rate at the end of step (D) in combination with a peak flow rate in the middle of step (D).

2. The method according to claim 1, wherein said peak flow rate ranges from about 50 ml/second to about 10 L/second.

3. The method according to claim 2, wherein said peak flow rate ranges from about 100 ml/second to about 5 L/second.

4. The method according to claim 1, wherein the total time for filling the second liquid feed composition during step (D) ranges from about 0.1 second to about 5 seconds.

5. The method according to claim 4, wherein said peak flow rate remains substantially constant for a duration that is at least 50% of the total filling time.

6. The method according to claim 1, wherein the increasing flow rate at the beginning of step (D) starts from 0 ml/second and reaches about 80% or more of the peak flow rate within a ramping-up duration of from about 0.1 second to about 1 second.

7. The method according to claim 1, wherein the decreasing flow rate at the end of step (D) starts from the peak flow rate and reaches 50% or less thereof within a ramping-down duration of from 0.05 second to 0.5 second.

8. The method according to claim 6, wherein the decreasing flow rate at the end of step (D) starts from the peak flow rate and reaches 10% or less thereof within a ramping-down duration of from 0.05 second to 0.5 second.

9. The method according to claim 1, wherein the decreasing flow rate at the end of (D) starts from the substantially constant flow rate and reaches 1-50% thereof within a ramping-down duration of from 0.05 second to 0.5 second, and then reduces to 0 ml/second within a shut-down duration of less than 0.01 second.

10. The method according to claim 9, wherein the decreasing flow rate at the end of (D) reduces to 0 ml/second within a shut-down duration of less than 0.001 second.

11. The method according to claim 9, wherein the decreasing flow rate at the end of (D) starts from the substantially constant flow rate and reaches 5-10% thereof within a ramping-down duration of from 0.05 second to 0.5 second.

12. The method according to claim 1, wherein said one or more liquid nozzles are connected to one or more flow-controlling devices for controlling the flow rates of said one or more liquid flows generated by the liquid nozzles, wherein said one or more flow-controlling devices are selected from the group consisting of valves, pistons, servo-driven pumps, and combinations thereof.

13. The method according to claim 12, wherein said one or more flow-controlling devices comprise one or more servo-driven pumps.

14. The method according to claim 1, wherein during step (C), the container is partially filled with the first liquid feed composition to from 0.1% to 50% of the total volume of said container.

15. The method according to claim 14, wherein during step (C), the container is partially filled with the first liquid feed composition to from 0.1% to 20% of the total volume of said container.

16. The method according to claim 1, wherein during step (D), at least 50% of the total volume of said container is filled with said second liquid feed composition.

17. The method according to claim 1, wherein said second liquid feed composition has an Aeration Level of 5% or less by volume.

18. The method according to claim 1, wherein the first liquid feed composition comprises one or more perfumes, colorants, opacifiers, pearlescent aids, enzymes, brighteners, bleaches, bleach activators, catalysts, chelants, polymers, and/or combinations thereof, and wherein the second liquid feed composition comprises one or more surfactants, solvents, builders, structurants, and/or combinations thereof.

19. The method according to claim 1, wherein the first liquid feed composition comprises a pearlescent aid selected from the group consisting of mica, titanium dioxide coated mica, bismuth oxychloride, and/or combinations thereof.

* * * * *